United States Patent [19]

Kamelmacher

[11] 3,964,840

[45] June 22, 1976

[54] BLADE FOR A CENTRIFUGAL PUMP IMPELLER

[76] Inventor: Eduard Kamelmacher, 8 Brook Lane, Bexley, Kent, England

[22] Filed: Dec. 30, 1974

[21] Appl. No.: 537,376

[30] Foreign Application Priority Data

Jan. 11, 1974 United Kingdom ..... 1521/74

[52] U.S. Cl. ..... 416/183; 416/188; 416/242

[51] Int. Cl.[2] ..... F01D 5/22

[58] Field of Search ..... 416/183, 180, 185, 182, 416/242, 188; 415/213 R

[56] References Cited

UNITED STATES PATENTS 1,062,006 5/1913 Hessling ..... 416/182

2,712,412 7/1955 West ..... 416/185 X

*Primary Examiner*—Harold W. Weakley

*Attorney, Agent, or Firm*—Stevens, Davis, Miller & Mosher

[57] ABSTRACT

A blade for a centrifugal pump impeller comprises a pressure end or blade tip lying in a first radius about the rotational axis joined to a suction end opposite the pressure end and lying in a second radius by a pumping surface having a concave portion adjacent the pressure end running into a convex portion adjacent the pressure end, the two radii being angularly spaced with the second radius leading in the direction of intended rotation.

10 Claims, 3 Drawing Figures

BLADE FOR A CENTRIFUGAL PUMP IMPELLER

BACKGROUND OF THE INVENTION

This invention relates to a blade for a centrifugal pump impeller for high speed centrifugal pumps and to an impeller incorporating such blades.

The blade of the invention is particularly suitable for use in centrifugal pumps which operate approximately in the range of 3,000 to 30,000 RPM.

In the design of high speed centrifugal pumps for various purposes, it has been common to provide the impeller rotor with a plurality of blades which are effectively radial with respect to the axis of rotation. The blades themselves are generally of such a nature as to have front and rear faces which are parallel thereby providing a flat blade which has one flat surface facing in the pumping direction and one flat surface facing away from the pumping direction.

This type of centrifugal pump has suffered from a number of disadvantages, in particular, the low efficiency of the pump, of the order of 55–58%, the reduction in the pressure head provided by the pump at low flow rates, and the fact that a high NPSH value is required because of the shock losses in the suction even at the specified flow.

Furthermore, the disadvantage also exists with radial blades that the blade is required to support the full reaction force of the pumped fluid by virtue of its inherent structural strength and no balancing of this force is otherwise achieved.

SUMMARY OF THE INVENTION

It is an object of the invention to provide a blade for a centrifugal impeller which has a construction which is advantageous in certain respects as compared to the known radial blade impeller.

According to a first aspect of the invention, there is provided a blade for a centrifugal pump impeller and rotatable about a blade rotational axis comprising a pressure end or blade tip lying on a first radius about said blade rotational axis, a suction end opposite to said pressure end on a second radius about said blade rotational axis, angularly spaced from said first radius with said second radius leading in the direction of intended blade rotation and inclined towards said blade rotational axis from one side of said blade to the other side of said blade and a pumping surface lying between said pressure end and said suction end including a concave portion adjacent said pressure end running in a convex portion adjacent said suction end and having a first angle defined by a tangent to said pumping surface at its said suction end and a tangent at this point to a circle with center on said rotational axis and radius equal to the distance of said suction end from said rotational axis in the range 25° to 90°, a second angle defined by a tangent to said pumping surface at the beginning of said inclination of said suction end of the blade and a tangent at this point to a circle with its center on said rotational axis and its radius equal to the distance of said beginning of said inclination from said rotational axis in the range 15° to 35° but smaller than said first angle and a third angle defined by a tangent to said pumping surface of said blade at its pressure end and a tangent at this point to a circle with its center on said rotational axis and a radius equal to the distance of said pressure end of said blade from said rotational axis in the range from 60° to 100°.

According to a second aspect of the invention, there is provided an impeller for a centrifugal pump having a plurality of blades rotatable about a blade rotational axis, each said blade comprising a pressure end or blade tip lying on a first radius about said blade rotational axis, a suction end opposite to said pressure end on a second radius about said blade rotational axis angularly spaced from said first radius with said second radius leading in the direction of intended blade rotation and inclined towards said blade rotational axis from one side of said blade to the other side of said blade and a pumping surface lying between said pressure end and said suction end including a concave portion adjacent said pressure end running into a convex portion adjacent said suction end and having a first angle defined by a tangent to said pumping surface at its said suction end and a tangent at this point to a circle with its center on said rotational axis and a radius equal to the distance of said suction end from said rotational axis in the range 25° to 90°, a second angle defined by a tangent to said pumping surface at the beginning of said inclination of said suction end of said blade and a tangent at this point to a circle with its center on said rotational axis and radius equal to the distance of said beginning of said inclination from said rotational axis in the range 15° to 35° but smaller than said first angle and a third angle defined by a tangent to said pumping surface of said blade at its pressure end and a tangent at this point to a circle with its center on said rotational axis and a radius equal to the distance of said pressure end of said blade from said rotational axis in the range 60° to 100°.

BRIEF DESCRIPTION OF THE DRAWINGS

The invention will now be described, in greater detail, by way of example, with reference to the drawings, in which.

DESCRIPTION OF THE PREFERRED EMBODIMENTS

Figure 1:
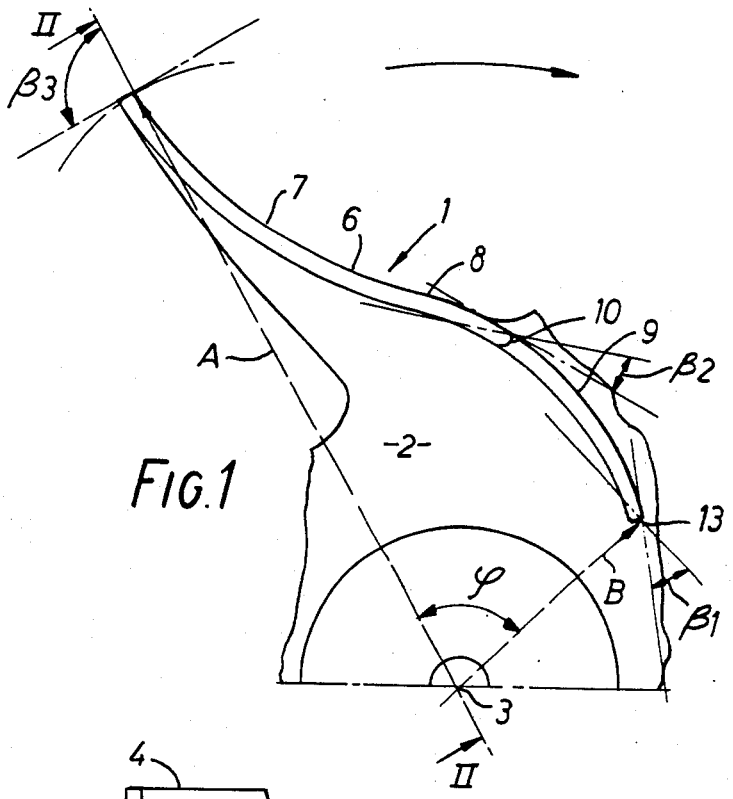
FIG. 1 is a side view of one blade constructed in accordance with the invention of an impeller.
Figure 2:
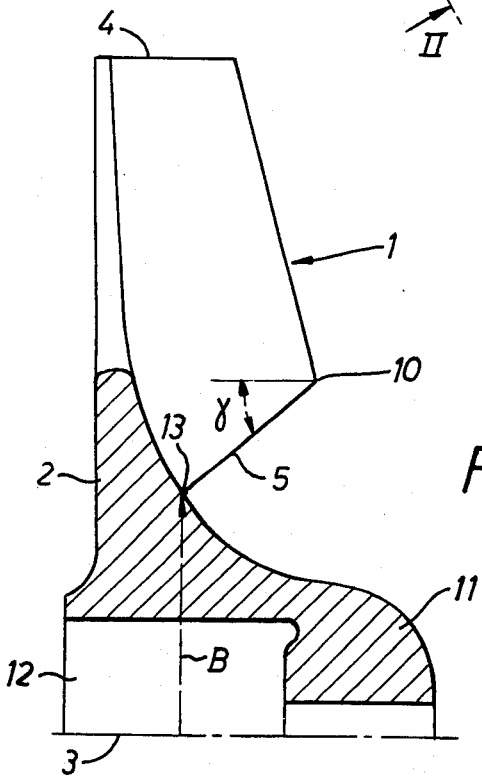
FIG. 2 is a side view taken on the line II—II of FIG. 1.
Figure 3:
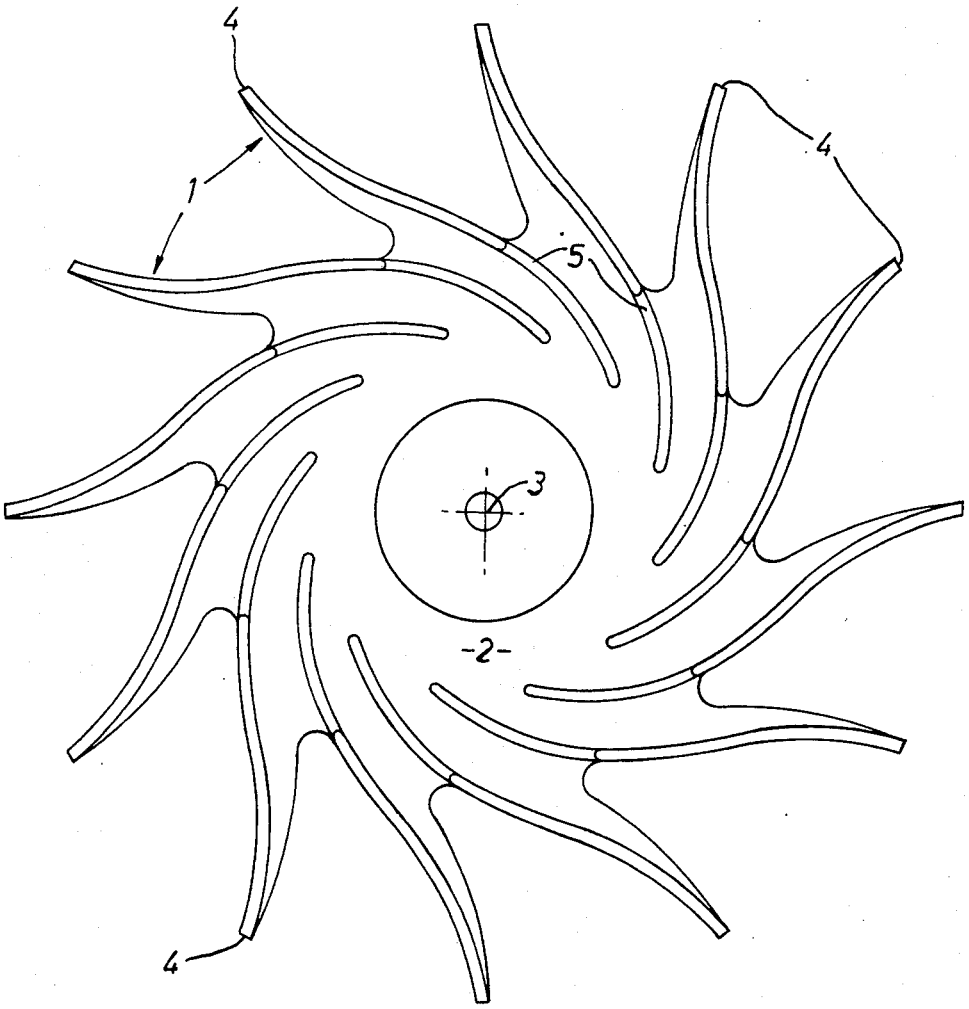
FIG. 3 is a side view of an impeller incorporating twelve blades of the type shown singly in FIGS. 1 and 2.

Referring to the drawings, it is to be understood that while the blades provided on the impeller of FIG. 3 overlap when considered in the radial direction, adjacent blades have been omitted for clarity in both FIGS. 1 and 2.

As can be seen, the blades 1, the construction of which is shown in FIGS. 1 and 2, are intended basically to project from a rotor disc 2 (FIG. 3) which in turn is supported on a rotor shaft (not shown) but has an axis indicated at 3. The foot or root portion of the blade 1 is provided by the lower part of the disc 2 which extends into an annular arrangement for mounting on the shaft of the pump. The blade 1 itself has a tip 4 which is situated on a radius A and forms the pressure end of the blade and a suction end 5, forming the other end of the blade which lies on a second radius B and is adjacent the suction opening of the pump (not shown). The relative positions of the two ends of the blade are determined by the angle $\phi$ between the respective radii A and B which amount to in broad terms 30°–100° (preferably 70°–92°).

Between these ends, the blade defines a pumping surface 6 which consists of two parts, a concave part 7, which extends from the tip 4 to a point 8 approximately half-way down the blade 1 and a convex part 9 which extends therefrom to the suction end 5 of the blade. As can be seen from FIG. 1, this surface 6 throughout its whole length takes the form of a smooth curve.

From FIG. 2 it will be seen that the blade, as viewed from a plane at right angles to the rotary axis, has a relatively narrower portion at the tip which extends to its widest portion at 10. This point 10 is level with the outer dimensions of the suction inlet to the pump chamber. From the point 10, the blade has a cut-away portion which extends in a direction substantially across the flow of fluid from the suction intake to intersect the lower part of the disc 2 at point 13 on radius B.

The angle $\gamma$ of this cut-away portion with respect to the axial direction of rotation is of the order of 15°–60° (preferably 30°–55°). The specific shape of the blade is basically defined with reference also to the angles $\beta_1$, $\beta_2$ and $\beta_3$ VIZ:

the angle $\beta_1$ is defined as the angle between the tangent to the blade at its suction end, and the tangent to the circle which has the axis 3 as its center and whose circumference passes through the point in question. It has a range of 25°–90° (preferably 30°–50°).

The angle $\beta_2$ comprises the angle between the tangent to the blade surface at the point 10 of largest axial width of the blade, and thus at the point where the blade is cut back, and the tangent to the circle about the axis of the impeller, which circle passes through this point. It has a range of 15°–35° (preferably 15°–25°).

$\beta_3$ is the angle between the tangent to the tip of the blade and the tangent to the circle about the axis 3 and representing the blade tip position. $\beta_3$ is in the range 60°–100° (preferably 80°–100°). The lower end of the blade carrying disc extends downwardly towards the shaft axis 3, extends parallel to the axis forming a hub-like portion and ends on one side with a form of cowling 11 covering the end of the rotor shaft bore 12 therein.

The construction of the blade as shown reduces the shock loss at the suction of the pump and is constructed at its outer or pressure end for reasonably close proximity with the diffusor of the pump in which the impeller is to be situated (not shown). As will also be seen, the center point of the attachment of the blade to the disc does not lie on the same radial line as the tip of the blade and furthermore behind each blade there is provided what amounts to a cut out from the disc to balance the axial thrust and reduce the friction losses. The positioning of the tip of the blade offset to the center point of the attachment means that the centrifugal action of the blade will not only have a radially outward component on the radius at this point, but there will also be a component extending in the circumferential direction in a direction opposite to the reaction pressure of the fluid being pumped. In this way, the centrifugal force inherent in the construction of the pump can be used at least to some extent to balance the reaction forces of the fluid being pumped which would otherwise attempt to bend the blade backwards and eventually restrict the maximum possible power and speed of rotation of the pump.

FIG. 3 shows the construction of an impeller in side view in which twelve blades of the type shown in FIGS. 1 and 2 are provided on the impeller. From the construction seen, it will be clear that with the orientation of the blades, these have considerable overlap when viewed in the radial direction. The additional overlap of these blades has been omitted from FIGS. 1 and 2 for the sake of clarity. With the construction shown, the 3–4 mm clearance between the impeller and chamber walls can be provided without significant disadvantage.

In a particular preferred form of blade, which is considered to be substantially the optimum, the angles involved are of the order of $\phi$ 75°, $\beta_1$45°, $\beta_2$20° and $\beta_3$90° and $\gamma$ 40°. With this pump arrangement, the expected efficiency is between 65 and 68% and a drop in pressure head with zero flow is expected to be 7% as compared to a normal drop of 40% in the known radial type of pump. The present blades are suitable for use in either gas or liquid pumps. Applications of such pumps are:

boiler feed water pumps, chemical process pumps, water injection pumps, water guns and gas compressors. The pumps are envisaged as rotating at speeds between 6,000 and 30,000 RPM and having a power consumption of their drive from small powers up to the order of 30 Megawatts, but it is to be understood that the invention is not limited to such speeds and powers.

It will be appreciated that various modifications can be made to the above described embodiments without departing from the scope of the invention. For example, the exact shape of the pumping surface of the blades can be varied depending on the circumstances and the overall angle of inclination in respect to the radial direction can also be varied particularly to take into account of different reaction pressures which may be present. As has been mentioned, the invention also includes an impeller provided with the blades and the number of blades can be any suitable number, suitably six, eight or 12.

It will be understood that the above description of the present invention is susceptible to various modification changes and adaptations.

What I claim is:

1. A blade for a centrifugal impeller and rotatable about a blade rotational axis comprising a pressure end or blade tip lying on a first radius about said blade rotational axis, a suction end opposite to said pressure end on a second radius about said blade rotational axis angularly spaced from said first radius with said second radius leading in the direction of intended blade rotation and inclined towards said blade rotational axis from one side of said blade to the other side of said blade and a pumping surface lying between said pressure end and said suction end including a concave portion adjacent said pressure end running into a convex portion adjacent said suction end, and having a first angle defined by a tangent to said pumping surface at its said suction end and a tangent at this point to a circle with center on said rotational axis and radius equal to the distance of said suction end from said rotational axis in the range 25°–90°, a second angle defined by a tangent to said pumping surface at the beginning of said inclination of said suction end of the blade and a tangent at this point to a circle with its center on said rotational axis and radius equal to the distance of said beginning of said inclination from said rotational axis in the range 15°–35° but smaller than said first angle and a third angle defined by a tangent to said pumping surface of said blade at its pressure end and a tangent at this point to a circle with its center on said rotational axis and a radius equal to the distance of said pressure end of said blade from said rotational axis in the range 60°–100°.

2. A blade as defined in claim 1, wherein the angle of said inclination of said suction end to said rotational axis is in the range 15°–60°.

3. A blade as defined in claim 2, wherein said angular spacing between said first and second radii is in the range 30°–100°.

4. A blade as defined in claim 1, wherein said first angle is in the range 30°–50°, said second angle is in the range 15°–25°, and said third angle is in the range 80°–100°.

5. A blade as defined in claim 4, wherein the angle of said inclination of said suction end to said rotational axis is in the range 30°–55°.

6. A blade as defined in claim 5, wherein said angular spacing between said first and second radii is in the range 70°–92°.

7. An impeller for a centrifugal pump having a plurality of blades rotatable about a blade rotational axis, each said blade comprising a pressure end or blade tip lying on a first radius about said blade rotational axis, a suction end opposite to said pressure end on a second radius about said blade rotational axis angularly spaced from said first radius with said second radius leading in the direction of intended blade rotation and inclined towards said blade rotational axis from one side of said blade to the other side of said blade, and a pumping surface lying between said pressure end and said suction end including a concave position adjacent said pressure end running into a convex position adjacent said suction end, and having a first angle defined by a tangent to said pumping surface at its said suction end and a tangent at this point to a circle with center on said rotational axis and radius equal to the distance of said suction end from said rotational axis in the range 25°–90°, a second angle defined by a tangent to said pumping surface at the beginning of said inclination of said suction end of the blade and a tangent at this point to a circle with its center on said rotational axis and radius equal to the distance of said beginning of said inclination from said rotational axis in the range 15°–35° but smaller than said first angle and a third angle defined by a tangent to said pumping surface of said blade at its pressure end and a tangent at this point to a circle with its center on said rotational axis and a radius equal to the distance of said pressure end of said blade from said rotational axis in the range 60°–100°.

8. An impeller as defined in claim 7 and comprising a disc to which said blades are joined at such suction ends and which has a hub-like portion from which the suction ends of said blades are spaced.

9. An impeller as defined in claim 8, wherein said blades overlap when considered in the radial direction of said disc.

10. An impeller for a centrifugal pump having a plurality of blades rotatable about a blade rotational axis, each said blade comprising a pressure end or blade tip lying on a first radius about said blade rotational axis, a suction end opposite to said pressure end on a second radius about said blade rotational axis angularly spaced from said first radius with said second radius leading in the direction of intended blade rotation and inclined towards said blade rotational axis from one side of said blade to the other side of said blade and a pumping surface lying between said pressure end and said suction end including a concave portion adjacent said pressure end running into a convex portion adjacent said suction end, and having a first angle defined by a tangent to said pumping surface of the blade at its suction end and a tangent at this point to a circle with center on said rotational axis and radius equal to the distance of said suction end of said blade from said rotational axis is in the range 30°–50°, a second angle defined by a tangent to said pumping surface of the blade at the beginning of said inclination of said suction end of said blade and a tangent at this point to a circle with center on said rotational axis and radius equal to the distance of said inclination from said rotational axis is in the range 15°–25° and a third angle defined by a tangent to said pumping surface of said blade at its pressure end and a tangent at this point to a circle with center on said rotational axis and radius equal to the distance between said pressure end of said blade and said rotational axis is in the range 80°–100°.

* * * * *